United States Patent [19]

Leemhuis

[11] Patent Number: 4,557,418

[45] Date of Patent: Dec. 10, 1985

[54] ENERGY CONSERVATION CONDITIONED AIR SYSTEM

[76] Inventor: Louis J. Leemhuis, 311 Promontory Dr. W., Newport Beach, Calif. 92660

[21] Appl. No.: 562,526

[22] Filed: Dec. 19, 1983

[51] Int. Cl.[4] ..... F24F 13/10

[52] U.S. Cl. ..... 236/49; 165/22

[58] Field of Search ..... 236/49, 9 A; 165/22

[56] References Cited

U.S. PATENT DOCUMENTS

| | | | |
|---|---|---|---|
| 379,201 | 3/1888 | Johnson | 236/49 X |
| 2,223,287 | 11/1940 | Kingsland | 236/49 X |
| 2,271,487 | 1/1942 | Nessell | 236/9 A |
| 3,568,760 | 3/1971 | Hogel | 165/22 |
| 4,147,298 | 4/1979 | Leemhuis | 236/49 |
| 4,277,019 | 7/1981 | Shreve | 236/49 |
| 4,334,648 | 6/1982 | Buth et al. | 236/49 |
| 4,394,958 | 7/1983 | Whitney et al. | 236/9 A X |

*Primary Examiner*—William E. Tapolcai

*Attorney, Agent, or Firm*—Poms, Smith, Lande & Rose

[57] ABSTRACT

A method and system for distributing heated or cooled air from a central pressurized source through a plurality of ducts to a number of spaces utilizing a minimum amount of energy. Each duct has a selectable high-low constant volume fluid flow controller which determines the amount of air flowing into each space according to a thermostat located in that space. A ductstat in the bonnet of the central source maintains the temperature in the bonnet in a narrow ideal desired range.

15 Claims, 6 Drawing Figures

ENERGY CONSERVATION CONDITIONED AIR SYSTEM

BACKGROUND OF THE INVENTION

1. Field of the Invention

This invention relates to the air conditioning and heating art and more particularly to a conditioned air system which is energy efficient utilizing a central source and constant volume controllers in each duct leading to the conditioned spaces.

2. Description of the Prior Art

The typical air conditioning and heating problem encountered in a building concerns the distribution of heated or cooled air from a central source to a plurality of spaces or rooms about the building located at various distances from the central source. Forced air systems blow the heated or cooled air from the central source through ducts out to the various rooms. Air in the duct system always flows most readily through the duct having the least amount of resistance. On the other hand, the least amount of air flows through the duct having the highest resistance. The most basic technique for attempting to equalize the flow to the various locations is to provide large diameter ducts to the remote locations and small diameter ducts to the closer locations. Fine tuning of the duct system can be then achieved by locating dampers at the ends of the ducts which may be adjusted to produce the desired result. However, at varying times during the day, the heating and cooling requirements in the various locations in the building change producing problems which are not solved in the most basic system and result in great energy inefficiencies.

Another problem inherent in most air conditioning and heating systems is that one thermostat at one location in the building controls the production of heated or cooled air by the central source. Again, variations in different portions of the system at different times of day often create conditions which cannot be satisfactorily solved by the use of a single thermostat for the central source.

Some systems have been designed incorporating various degrees of sophistication to provide the desired amount of heated or cooled air to a given room from a remote central source. The systems generally utilize constant volume flow controllers operating dampers located in the various ducts which are responsive to fluid flows through the particular ducts and temperatures in the rooms being conditioned. These constant volume controllers are subject to breakdown because of the complexity of the physical parts and inefficient because of the failure to coordinate with the heating or cooling output of the central source that is determined by a centrally located thermostat. In addition, the majority of the control systems operate best at a desired average level and are unable to cope adequately with extreme conditions which require rapid heating or cooling to achieve satisfactory conditions in a short time.

Another problem often encountered in constant volume controllers is the inability to measure turbulent flow conditions such as are encountered at corners and divisions. Continuously high or low fluid flow problems result.

SUMMARY OF THE INVENTION

Accordingly, it is an object of the present invention to provide an improved conditioned air system which is energy efficient.

It is another object of the present invention to provide a constant volume controller for hot and cold forced air systems which allows selection of high or low volume modes according to the temperature in the space being conditioned.

It is another object of the present invention to provide a simpler and more reliable constant volume controller.

It is another object of the present invention to provide a forced air heating and cooling system having constant volume controllers in each duct and a central source operating within a narrow temperature range determined by a ductstat located in the central source.

It is another object of the present invention to provide a forced air heating and air conditioning system that is energy efficient and that requires a minimum of expense for equipment.

It is yet another object of the present invention to provide a vane for constant volume controllers having a surface that may be adjusted to measure turbulent flow conditions in ducts.

The above, and other objects of the present invention are achieved according to a preferred embodiment thereof, by providing a ductstat in the bonnet of the source of heated or cooled air which controls the source according to an ideal narrow desired temperature range in the bonnet producing significant energy savings in comparison to traditional systems having a remote central thermostat requiring a wider temperature range. The bonnet is connected to a plurality of ducts which radiate about the building to the various spaces or rooms that are heated or cooled by the central source. A blower at the central source forces the air in the bonnet through the ducts and out into the various rooms. A selectable dual mode constant volume controller in each duct regulates the flow of fluid through the duct according to the temperature in the room to be conditioned and to air flow changes in the duct as measured by a vane in the duct. A baffle rotated by an electric motor opens or closes as determined by the controller.

A solenoid operated by a thermostat in the conditioned space allows selection between the two modes of operation of the fluid flow controller. A high volume is allowed when the temperature in the conditioned space is either below the desired temperature when the entire system is in the heating mode or is above the desired temperature when the entire system is in the cooling mode. When the solenoid is in the retracted position, a biasing spring on one end of the actuator of the solenoid provides a minimum of pressure against movement of the vane in the duct. A small increase in the flow of air in the duct on the vane therefore causes the baffle to partially close. When the solenoid is in the activated or advanced position, the spring pressing against the vane is compressed causing the biasing pressure to increase which requires a greater increase in the air flow in the duct before the baffle partially closes. Under normal operating conditions, a relatively low constant volume of air passes through the duct. Under rapid heating or cooling conditions, the activation of the solenoid requires a higher volume of air in the duct before the baffle is partially closed. In this manner, rapid heating or cooling of the conditioned space is possible.

The operation of the overall system is best given by an example. Assuming that the building is being heated, efficient nighttime operation of the heating system requires the setting of the bonnet ductstat at a low temperature. In the morning, people begin to work at various locations throughout the building. The ductstat is either automatically adjusted to a daytime temperature or is adjusted by the first person to arrive which causes the central source to heat up the air in the bonnet. The various thermostats around the building in the various rooms have not been changed and are all indicating to the fluid flow controllers in the ducts to operate at maximum flow conditions. As the heat level rises, some of the rooms will achieve the desired temperature level faster than others. In the present invention, the fluid flow controllers in the ducts serving those rooms will switch to the low volume mode obstructing some of the air flow through the ducts. Air flow in the other ducts does not increase by this action because all of the ducts have constant volume controllers which are already operating at maximum. Instead, the demand on the central blower is diminished causing the use of less energy by the blower. The air in the bonnet will also cool less rapidly causing the heat source to operate less frequently. Eventually all of the rooms will be heated to the desired temperature causing all of the fluid flow controllers to switch to the low volume mode. Cycling of the heating source will be at a minimum when all of the rooms have reached the desired temperature. In this manner, optimal energy efficiency is achieved through the utilization of uncomplicated and inexpensive equipment.

BRIEF DESCRIPTION OF THE DRAWINGS

The above and other embodiments of the present invention may be more fully understood from the following detailed description taken together with the accompanying drawing wherein similar reference characters refer to similar elements throughout and in which.

DESCRIPTION OF THE PREFERRED EMBODIMENT

Figure 1:
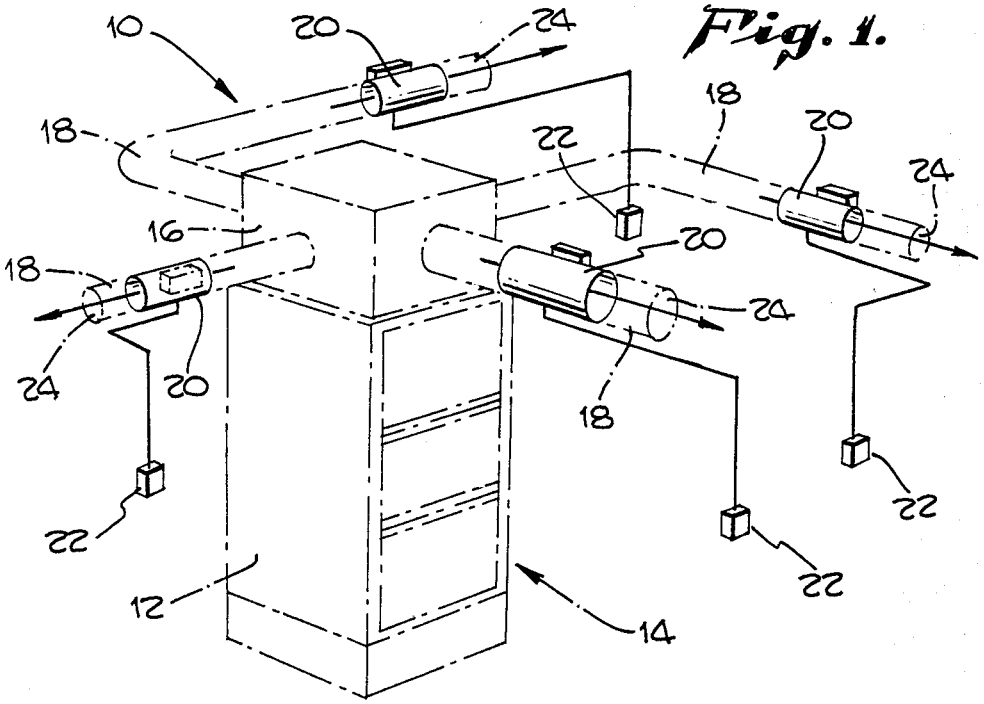
FIG. 1 is a perspective view of the energy conservation conditioned air system.

Referring now to the various figures of the drawings, there is illustrated in FIG. 1 a perspective view of an energy conservation conditioned air system, generally designated 10, of the present invention. Furnace 12 contains a standard burner and heat exchanger system for heating air and also an air conditioner coil for cooling air from an air conditioner which is not illustrated. A blower inside furnance 12 provides pressure for blowing air throughout conditioned air system 10. Thus, furnace 12 is a typical pressurized central source 14 for providing conditioned air in a building. The heated or cooled air initially flows into bonnet 16 on top of furnace 12 which acts as a manifold to distribute the conditioned air through ducts 18 throughout the building. Each duct 18 has a constant volume controller 20 which regulates the amount of air being delivered to any given space according to the amount of air flowing through duct 18 and adjusted to meet the desired temperature by a space control in the form of thermostat 22. FIG. 1 is a stylized drawing which does not illustrate the remote rooms but one thermostat 22 and one duct outlet 24 are located in each room.

Figure 2:
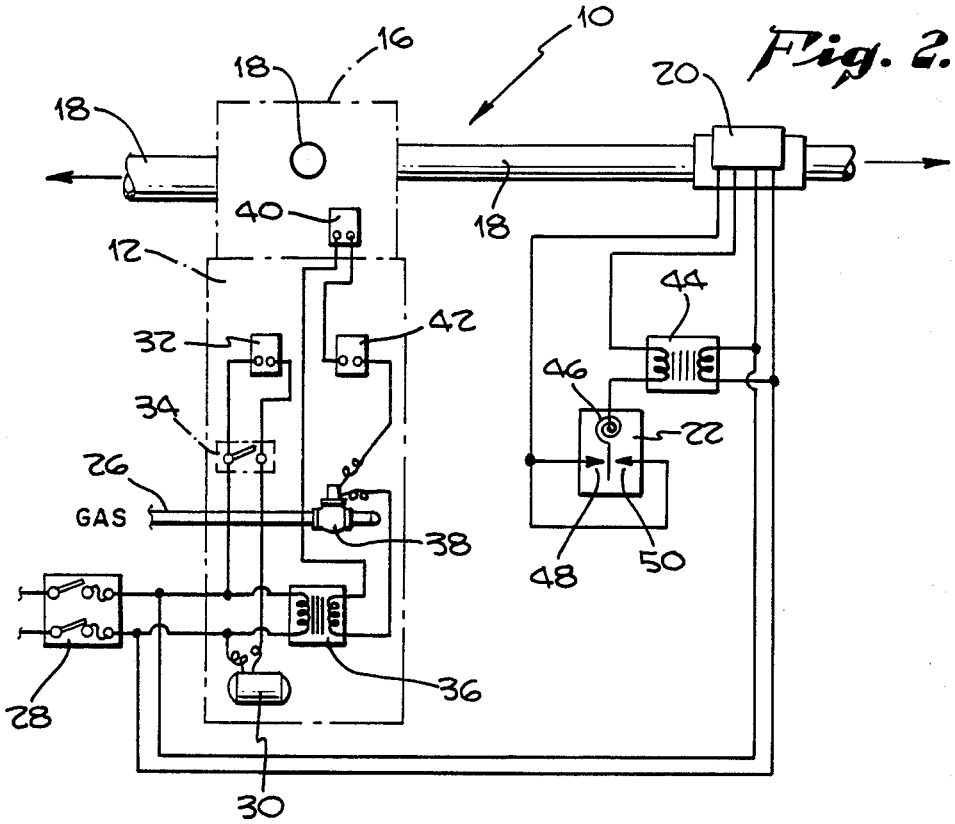
FIG. 2 is a circuit diagram of a portion of the system illustrated in FIG. 1.

FIG. 2 is a side elevational view and partial wiring diagram of conditioned air system 10. Furnace 12 is a gas furnace receiving gas through pipe 26. Standard 120 volt electric power is supplied to furnace 12 through switch 28 to provide power to the controls operating the various functions of conditioned air system 10. Blower motor 30 is controlled either by fan thermostat 32 or manual switch 34. Blower motor 30 operates a blower which is the source of the pressurized fluid for operation of conditioned air system 10. Fan thermostat 32 turns on blower motor 30 when the temperature in furnace 12 reaches a certain level if the conditioned air system 10 is operating in the heating mode. Alternatively, fan thermostat 32 turns on blower motor 30 when a certain low temperature is reached when furnace 12 is in the air conditioning mode.

The remainder of the control circuit on furnace 12 operates on a lower 24 volt control voltage supplied by transformer 36. Gas valve 38 is opened when furnace 12 is in the heating mode by a central source control in the form of bonnet ductstat 40 in bonnet 16 when the temperature in bonnet 16 drops belows a desired level. In usual furnace control situations, the thermostat is located in a central part of a building or house. The conditioned air system under those circumstances does not have a bonnet ductstat 40.

The location of ductstat 40 in bonnet 16 is an important part of obtaining the energy conservation characteristics of the present invention. Instead of furnace 12 operating over a wide temperature band according to the temperature in a central location in a house or building, ductstat 40 quickly adjusts the operation of furnace 12 according to the temperature immediately above furnace 12 in bonnet 16. Ductstat 40 allows the temperature of the air inside bonnet 16 to be maintained at a desired level within a narrow temperature band having inherent energy conservation characteristics. The air is then distributed through ducts 18 according to demand requirements determined by controllers 20. Safety switch 42 on the side of furnace 12 keeps furnace 12 from overheating if there is a failure in ductstat 40.

FIG. 2 also shows on the right hand side a portion of the control circuit for controller 20. Line voltage is delivered both to controller 20 and transformer 44. Transformer 44 supplies a low 24 volt control voltage to room thermostat 22. Room thermostat 22 contains a bimetallic coil 46 which closes against high temperature contact 48 when the temperature in the room reaches an undesirable high level and closes against low temperature contact 50 when the temperature in the room reaches an undesirable low level.

Figure 3:
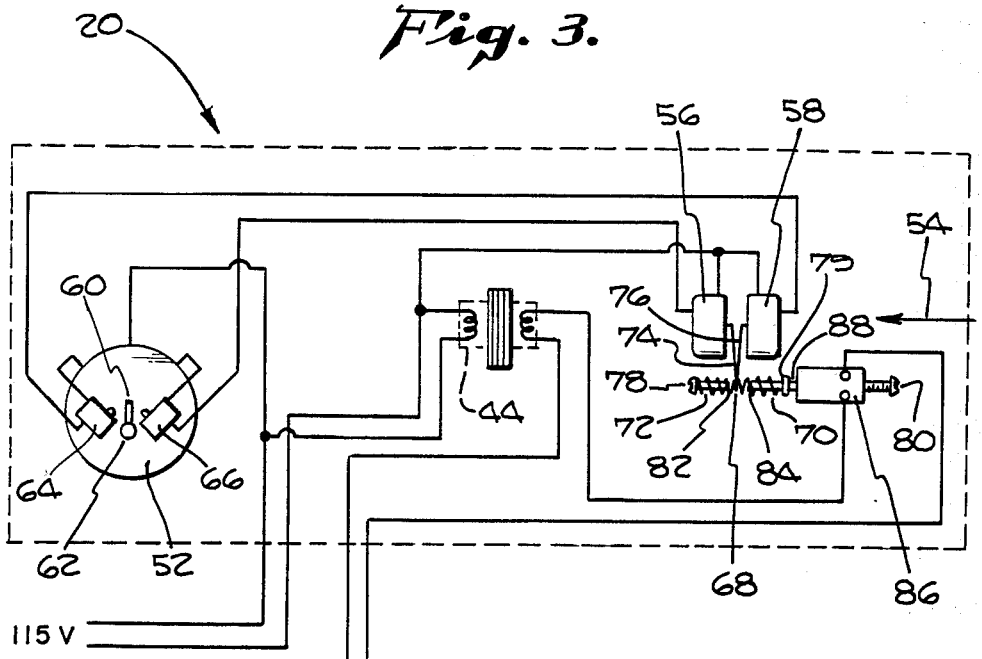
FIG. 3 is a circuit diagram of the constant volume controller of the present invention.

FIG. 3 shows a more detailed electrical circuit for controller 20. Thermostat 22 is located in the lower left corner. The upper box in FIG. 3 represents the small box on duct 18 identified as controller 20 in FIG. 2. Controller 20 operates by moving a damper in duct 18 by means of damper motor 52. Air passing through duct 18 underneath fluid flow controller 20 moves in the direction indicated by arrow 54. The air first encounters a vane underneath vane switches 56 and 58. When the air flow in duct 18 is moderate, the vane does not activate either open van switch 56 or close vane switch 58. When the air flowing through duct 18 increases above the desired level, the vane moves and activates close vane switch 58 which sends electricity to damper motor 52 causing damper motor 52 to begin to close the damper in duct 18. As damper motor 52 rotates, lever 60 coupled to damper shaft 62 eventually touches close limit switch 64 which opens the electric circuit to damper motor 52 when the damper in duct 18 is totally closed. When the air flow indicated by arrow 54 through duct 18 is below the desired level, the vane activates open vane switch 56 sending an electric current to damper motor 52 which rotates in the opposite direction to open the damper until either the vane stops pushing open vane switch 56 or lever 60 touches open limit switch 66 on damper motor 52.

The vane is held in a central position indicated at point 68 by biasing means springs 70 and 72. The movement of the van away from point 68 in either direction compresses the spring in that direction creating additional force to push the vane back to point 68. After the vane has moved sufficiently away from point 68, sensor means in the form of one of switches 56 or 58 is activated through switch lever arms 74 or 76 to cause damper motor 52 to operate in the manner described in the preceding paragraph. Adjustment of the bias of springs 70 and 72 is achieved by turning adjustment screws 78 or 80. Turning screw 78 and nut 79 toward point 68 causes the bias of springs 70 and 72 to increase toward point 68. In this manner, the operation of damper motor 52 by the vane can be adjusted to the desired parameters. Limit stops 82 and 84 on either side of point 68 provide physical limits beyond which the vane cannot move.

One of the improvements of the present invention is the provision of a biasing means enhancer solenoid 86 which, when activated by thermostat 22, increases the bias on spring 70. As described in connection with FIG. 2, thermostat 22 closes a circuit whenever the temperature in the space being conditioned reaches either a high temperature or low temperature depending upon whether the conditioned air system 10 is in the heating or air conditioning mode. When armature 88 of solenoid 86 is in the advanced position, increased air flow through duct 18 is required before close vane switch 58 is activated to close the damper. In this manner, the present invention operates more rapidly than prior art systems when the present system is turned on or conditions in the room change dramatically. The position of limit stop 84 also changes when armature 88 of solenoid 86 is advanced providing further assurance of rapid conditioning of the air in the room being serviced. It should be noted that when armature 88 of solenoid 86 is not advanced, spring 70 pushes against armature 88 causing it to rest against adjustment screw 80. Thus, the position of limit stop 84 when armature 88 is retracted is determined by adjustment screw 80.

Figure 6:
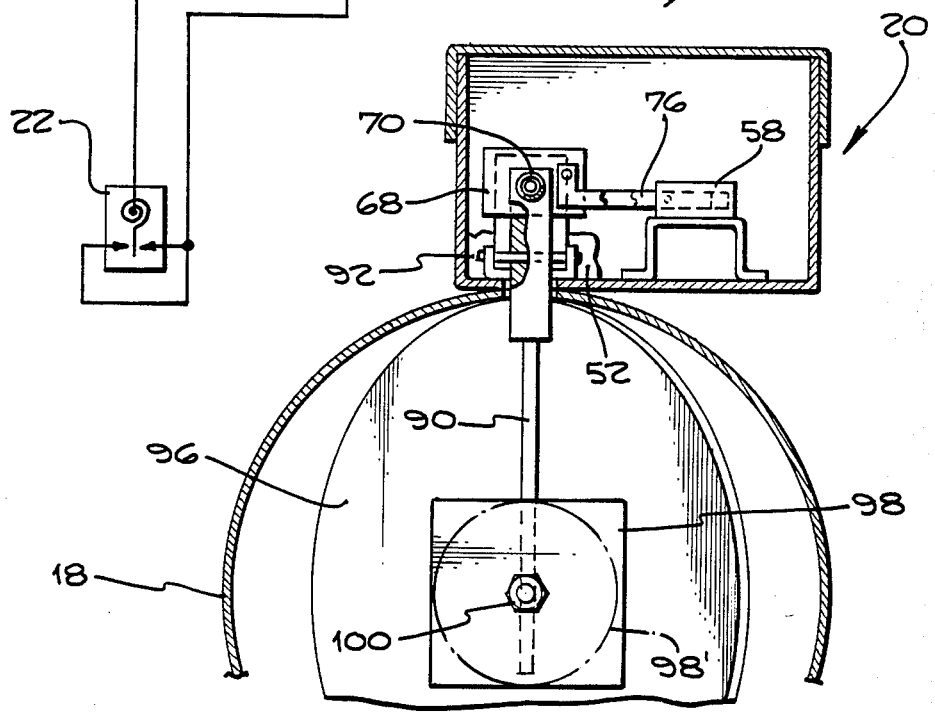
FIG. 6 is a sectional view along line VI—VI of FIG. 4.
Figure 5:
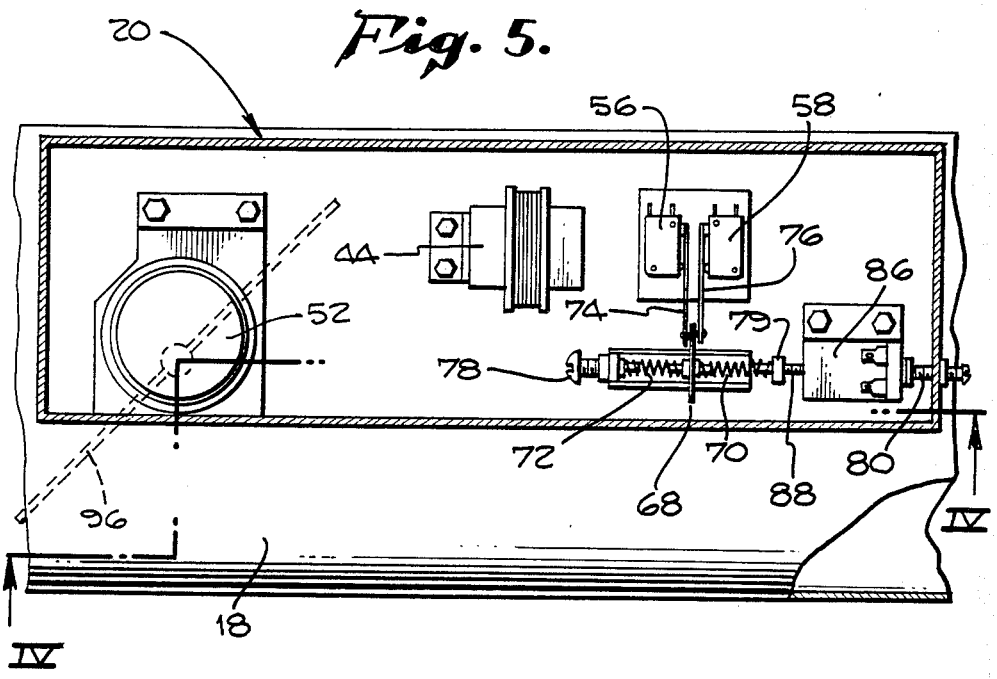
FIG. 5 is a sectional top view of the present invention installed in a duct.
Figure 4:
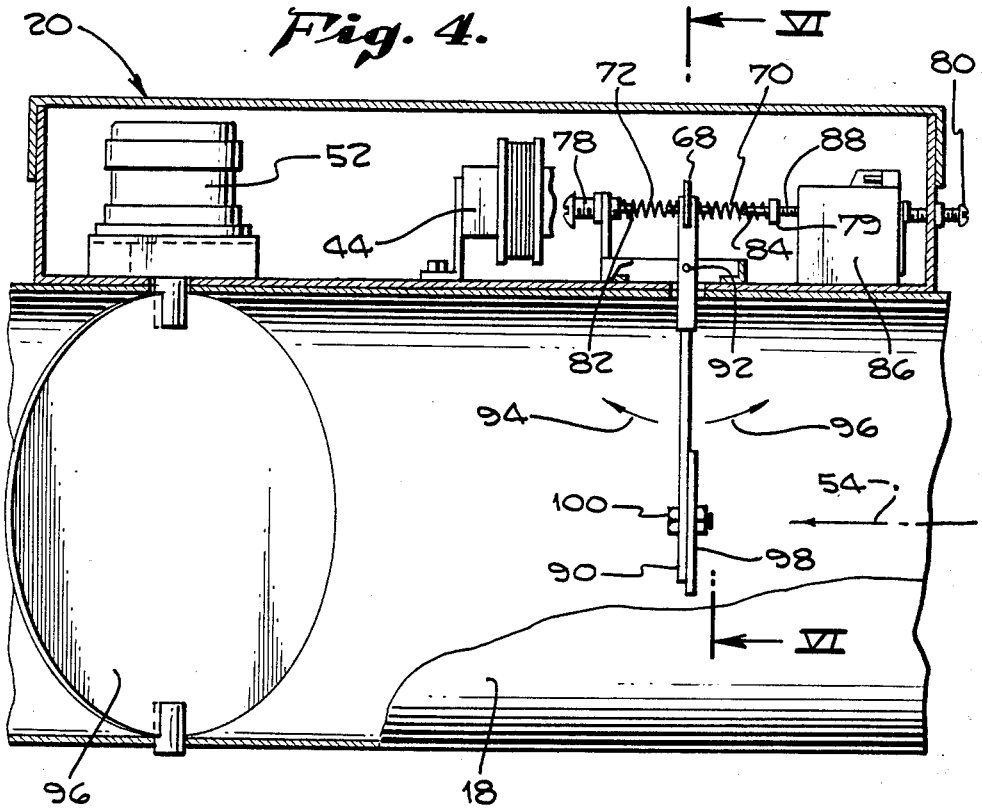
FIG. 4 is a sectional side view of the present invention installed in a duct.

FIGS. 4, 5 and 6 provide more physical details of the various parts of constant volume controller 20. FIG. 4 is a sectional side elevational view of controller 20 and duct 18 shown in FIGS. 1 and 2. Air passes through duct 18 in the direction of arrow 54 and initially hits vane 90. Vane 90 rotates about pivot 92 in the direction of arrows 94 and 96 depending upon the relative strength of the air flow indicated by arrow 54 and biasing springs 70 and 72. The operation of vane 90 is discussed above in conjunction with FIG. 3. Damper 96 is opened and closed in duct 18 by damper motor 52 as also discussed above in conjunction with FIG. 3.

FIG. 5 is a sectional top view of controller 20 and duct 18 of FIGS. 1 and 2.

FIG. 6 is a sectional view of FIG. 4 along line VI—VI. Vane 90 in duct 18 acts on vane switches such as close vane switch 58 to cause damper motor 52 in controller 20 to rotate damper 96 into the position desired. The sail 98 of vane 90 is made in the shape of a square in order to allow adjustment of sail 98 around bolt 100 to account for turbulent air conditions inside duct 18 which are often encountered at corners or divisions. The location of controller 20 nearer to corners and divisions in conduit 18 is thereby possible than would be possible with a circular sail 98′ indicated by the dotted line.

Having now reviewed the above description and the drawings, those skilled in the art will realize that a wide variety of embodiments may be employed in producing equipment in accordance with the present invention. In many instances, such embodiments may not even resemble that depicted here and may be used for applications other than that shown and described. Nevertheless, such embodiments will employ the spirit and scope of the invention as set forth in the following claims.

What is claimed is:

1. A method for conditioning and distributing a pressurized fluid from a central source to a plurality of remote spaces in an energy conserving manner which comprises:

(a) providing a source control in the central source for maintaining the conditioning of the fluid within a narrow range;

(b) providing at least one duct from said central source to each of said plurality of remote spaces;

(c) controlling the flow of said fluid through each of said ducts by a dual mode constant volume controller located in each of said ducts which selectably allows either a high or a low volume of fluid flow;

(d) providing at least one space control located in each of said plurality of remote spaces; and (e) controlling the volume controller in the duct to a given remote space by a space control in the given remote space which selects the high volume of fluid flow when the condition in the conditioned space is outside of a desired range and selects a low volume of fluid flow when the condition in the conditioned space is within the desired range, each of said volume controllers having a vane disposed in its respective duct and held in a central position by biasing means when no fluid flows through the duct, said vane being deflected by the passage of the fluid in the duct, said vane operating a motor turning a damper to selectively open and close the duct according to the passage of fluid through the duct, a two position biasing means enhancer increasing the bias on said vane opposite the fluid flow requiring a high volume fluid flow before said vane operates said motor to close said damper when said two positon biasing means enhancer is in an advanced position determined by said given space control detecting a condition in said conditioned space outside of a desired range; and, said two position biasing means enhancer decreasing the bias on said vane opposite the fluid flow requiring a low volume fluid flow before said vane operates said motor to close said damper when said two position biasing means enhancer is in a rest position determined by said given space control detecting a condition in said conditioned space inside of a desired range.

2. The method of claim 1 wherein said vane is biased to a central position by a spring on each side of an arm of said vane and said two position biasing means enhancer pushes on one of the springs when activated to increase the bias of the pushed spring.

3. The method of claim 2 wherein said two position biasing means enhancer is a solenoid driven into an advanced position by electricity and returned to a rest position by said springs.

4. The method of claim 3 wherein said fluid is air, said source control is a ductstat maintaining the temperature of the air within said central source within a narrow range, said space controls are thermostats, and said plurality of remote spaces are rooms.

5. A selectable dual mode high-low constant volume controller for a fluid delivery system having a duct for directing fluid from a pressurized source into a space to be conditioned by said fluid and a space control in said space connected to said volume controller for measuring the condition to be conditioned by said fluid comprising in combination:

a movable damper in said duct for obstructing the flow of fluid through said duct;

a motor for holding and positioning said damper;

a vane in said duct for measuring the volume of fluid flow through said duct;

biasing means on said vane for centering said vane when no fluid flows through said duct;

sensor means adjacent said vane for sensing the position of said vane connected to said motor and causing said motor to operate according to the position of said vane; and means for selecting between a high volume mode of fluid passage through said duct and a low volume mode of fluid passage through said duct operated by said space control whereby said space control causes said means for selecting between a high volume mode and a low volume mode to select the high volume mode when the condition in the conditioned space is outside of a desired range and to select the low volume mode when the condition in the conditioned space is within the desired range, said biasing means comprising at least one spring on either side of said vane and said means for selecting between a high volume mode and a low volume mode comprising a biasing means enhancer which selectively increases the bias of said at least one spring operating on said vane opposite the fluid flow.

6. The arrangement defined in claim 5 wherein said biasing means enhancer is a two position solenoid.

7. The arrangement defined in claim 6 and further comprising adjustment screws for adjusting the bias of said at least one spring on either side of said vane.

8. The arrangement defined in claim 7 wherein said adjustment screw adjusting the bias of said at least one spring operating on said vane opposite the fluid flow adjusts the rest position of the armature of said solenoid, the end of said armature away from said armature at rest adjusting screw is a limit stop physically limiting the movement of said vane, and the end of said adjustment screw on the other side of said vane provides another limit stop beyond which the vane cannot move.

9. The arrangement defined in claim 5 wherein said pressurized source further comprises fluid heating means.

10. The arrangement defined in claim 5 wherein said pressurized source further comprises fluid cooling means.

11. The arrangement defined in claim 9 wherein said pressurized source further comprises fluid cooling means.

12. The arrangement defined in claim 9 wherein said pressurized source further comprises a source control for controlling said fluid heating means in said pressurized source.

13. The arrangement defined in claim 10 wherein said pressurized source further comprises a source control for controlling said fluid cooling means in said pressurized source.

14. The arrangement defined in claim 11 wherein said pressurized source further comprises a source control for controlling said fluid heating and cooling means in said pressurized source.

15. The arrangement defined in claim 5 wherein said vane has a rectangular sail allowing said sail to be adjusted to measure turbulent air conditions encountered near corners and divisions of said duct.

* * * * *